US005986521A

United States Patent [19]

Tada et al.

[11] Patent Number: 5,986,521

[45] Date of Patent: Nov. 16, 1999

[54] MULTI-PASSBAND FILTER

[75] Inventors: Hitoehi Tada; Hideyuki Katoh, both of Ishikawa-ken; Haruo Matsumoto, Kanazawa, all of Japan

[73] Assignee: Murata Manufacturing Co., Ltd., Japan

[21] Appl. No.: 08/964,186

[22] Filed: Nov. 4, 1997

[30] Foreign Application Priority Data

Nov. 5, 1996 [JP] Japan ..... 8-292507

[51] Int. Cl.[6] ..... H01P 5/12; H01P 1/205; H01P 1/203

[52] U.S. Cl. ..... 333/134; 333/203; 333/206; 333/204

[58] Field of Search ..... 333/202, 203, 333/206, 207, 126, 129, 134, 204

[56] References Cited

U.S. PATENT DOCUMENTS

| | | | |
|---|---|---|---|
| 5,191,305 | 3/1993 | Frost et al. | 333/202 |
| 5,712,648 | 1/1998 | Tsujiguchi | 333/134 X |

FOREIGN PATENT DOCUMENTS

| | | | |
|---|---|---|---|
| 538894 | 10/1992 | European Pat. Off. . | |
| 641035 | 8/1994 | European Pat. Off. . | |
| 654842 | 11/1994 | European Pat. Off. . | |
| 704924 | 9/1995 | European Pat. Off. . | |
| 707352 A1 | 4/1996 | European Pat. Off. | 333/206 |
| 57-13801 | 1/1982 | Japan | 333/202 |

OTHER PUBLICATIONS

Matsumoto, H., et al., "A Miniaturized Dielectric Monoblock Duplexer Matched by the Buried Impedance Transforming Circuit", *IEEE MTT–S International Microwave Symposium Digest*, Orlando, May 16–20, 1995, vol. 3, pp. 1539–1542, May 16, 1995.

*Primary Examiner*—Seungsook Ham
*Attorney, Agent, or Firm*—Ostrolenk, Faber, Gerb & Soffen, LLP

[57] ABSTRACT

A multi-passband filter includes a dielectric member (1), a plurality of resonant lines (12*a*–12*c*,13,14*a*–14*d*,15*a*–15*c*) provided within or on the dielectric member (1) and the resonant lines (12*a*–12*c*,13,14*a*–14*d*,15*a*–15*c*) are coupled to adjacent resonant lines so that a plurality of resonators are provided. At least one pair of resonant lines (12*a*–12*c*,13, 14*a*–14*d*,15*a*–15*c*) are interdigitally coupled to each other in such a manner that the open ends and short-circuited ends of said resonant lines (12*a*–12*c*,13,14*a*–14*d*,15*a*–15*c*) are located in opposite directions with respect to each other, thereby providing a band-elimination filter. At least one pair of said resonant lines (14*a*–14*d*) may be comb-line coupled to each other in such a manner that the open ends and short-circuited ends of said resonant lines (14*a*–14*d*) are located in the same direction with respect to each other, thereby providing a band-pass filter. The multi-passband filter requires only a limited space to dispose the band-elimination filter in the filter. It is unnecessary to provide a phase shifter between the band-elimination filter and an input/output terminal when the band-elimination filter and the other filter are combined to input or output signals through a common input/output terminal.

19 Claims, 10 Drawing Sheets

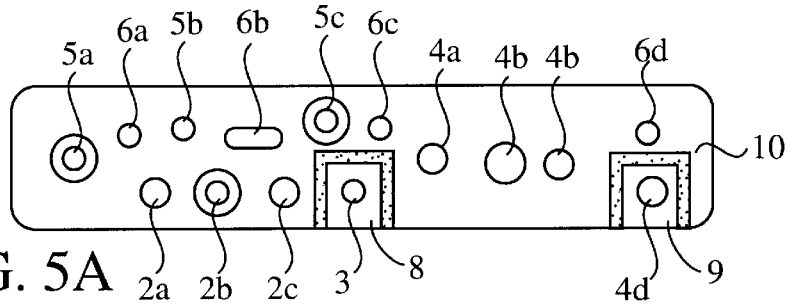
FIG. 5A
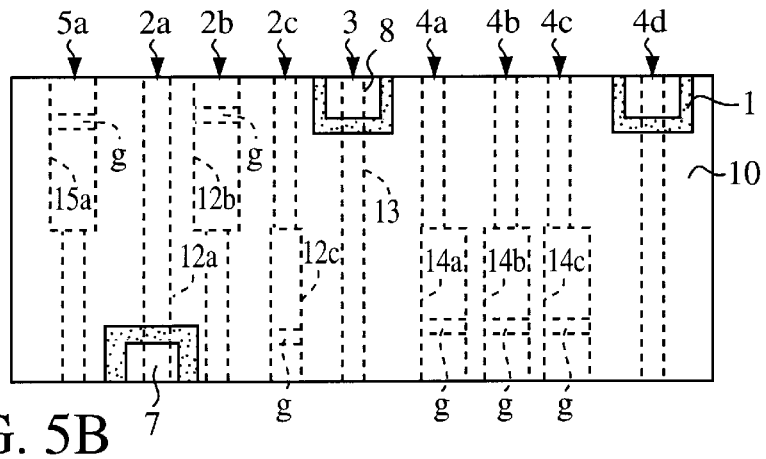
FIG. 5B
FIG. 5D
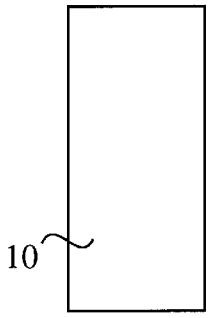
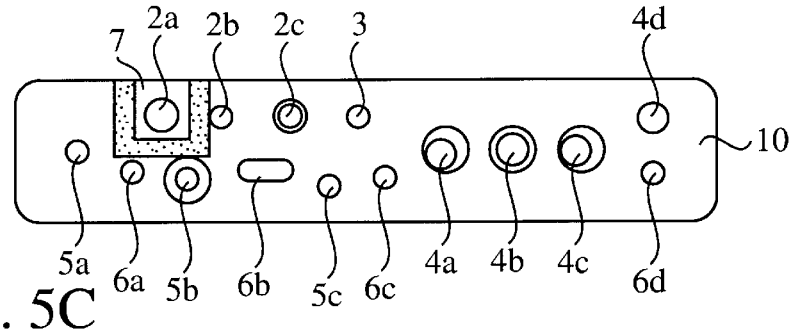
FIG. 5C
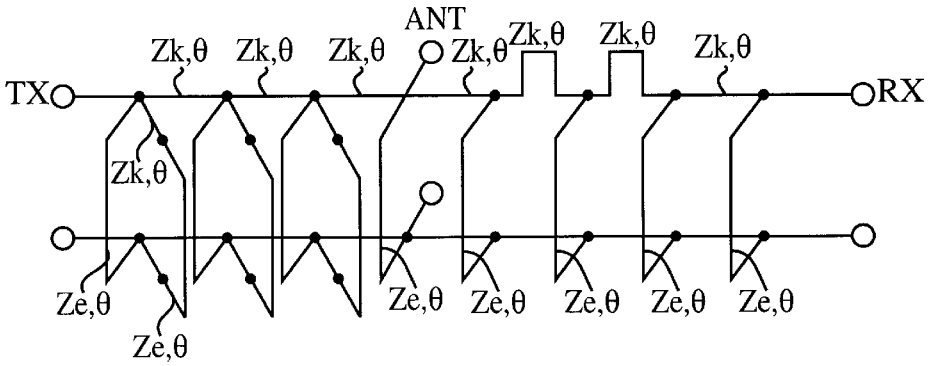
FIG. 6

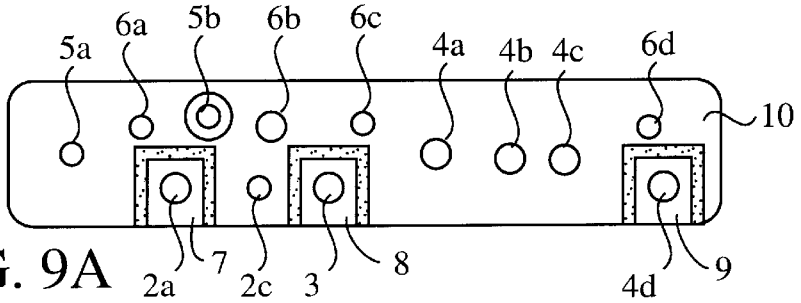
FIG. 9A
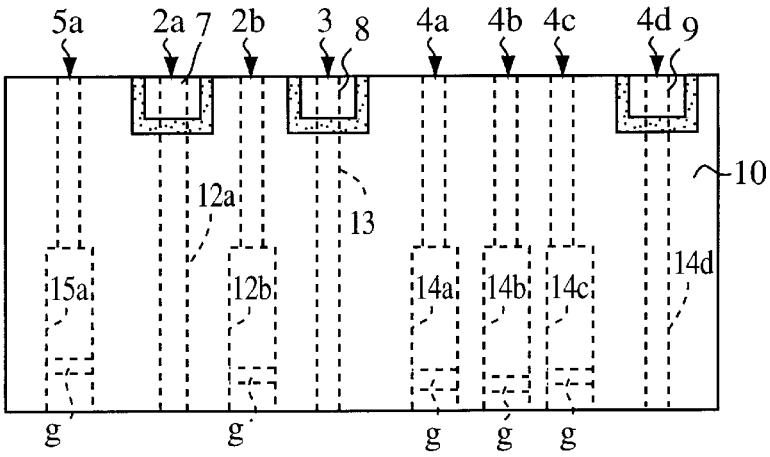
FIG. 9B
FIG. 9D
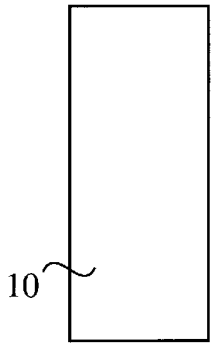
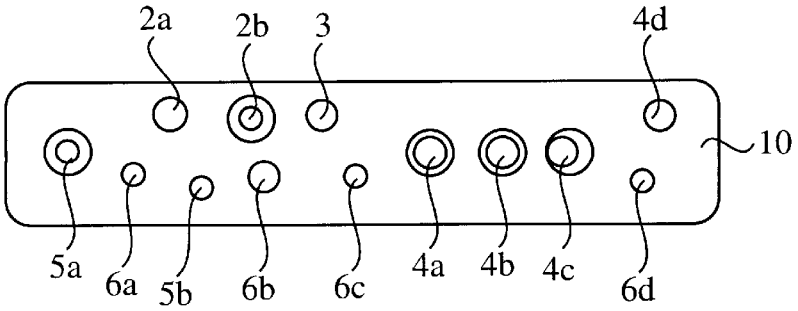
FIG. 9C

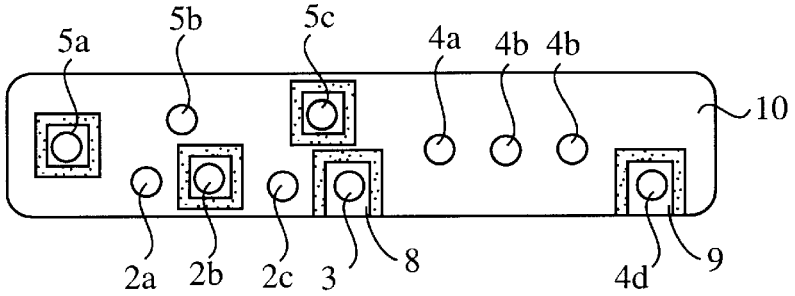
FIG. 10A
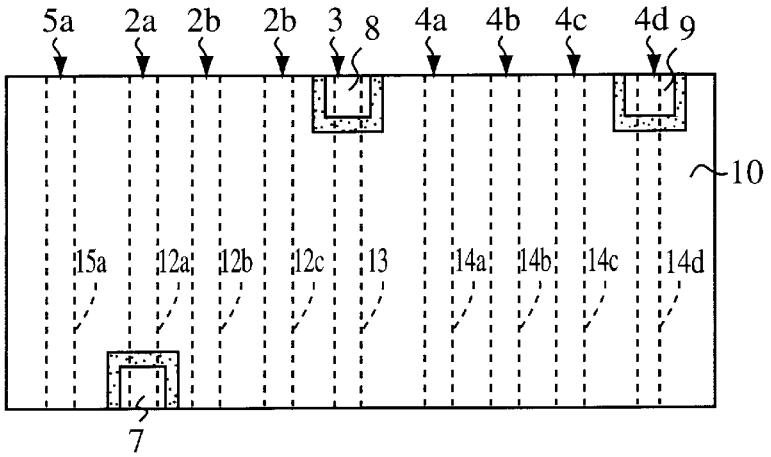
FIG. 10B
FIG. 10D
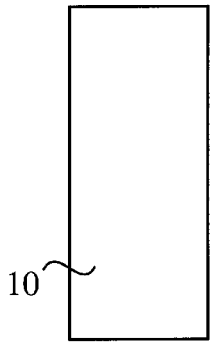
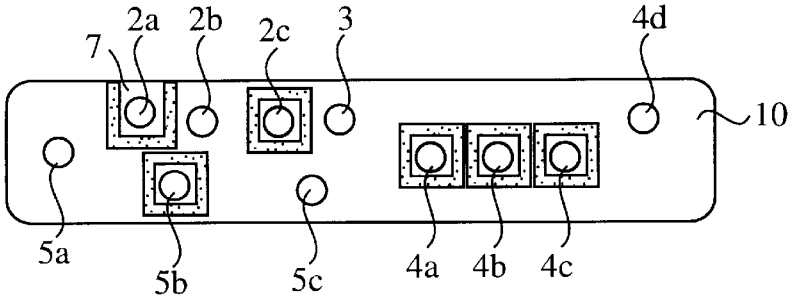
FIG. 10C

MULTI-PASSBAND FILTER

BACKGROUND OF THE INVENTION

1. Field of the Invention

The present invention relates to a multi-passband filter. More particularly, the invention relates to a multi-passband filter comprising a dielectric member, a plurality of resonant lines provided within or on said dielectric member, and each of the resonant lines being coupled to the adjacent resonant line or lines. The multi-passband filter is for use in mobile communication apparatus.

2. Description of the Related Art

An example of a conventional antenna-duplexer unit formed by a plurality of filters in a single dielectric block is shown in FIGS. 14(A) and 14(B). FIG. 14(A) is a front view of the dielectric filters for use in the antenna-duplexer unit, and FIG. 14(B) is a longitudinal sectional view of the dielectric filters. In FIGS. 14(A) and 14(B), a dielectric block 1 has ground conductors 10 on the peripheral surfaces other than the front surface of the dielectric block 1. A plurality of resonant-line holes 31*a* through 31*i* are provided in the dielectric block 1 in which resonant lines 32*a* through 32*i* are formed, respectively. Rectangular-shaped electrodes, continuously extending from the respective resonant lines 32*a* through 32*i*, are formed on the open front surface of the dielectric block 1. Moreover, input/output-coupling electrodes 33*a*, 33*b* and 33*c* are inserted between the resonant-line holes 31*a* and 31*b*, between the holes 31*d* and 31*e*, and between the holes 31*h* and 31*i*, respectively, thereby capacitively coupling the adjacent rectangular electrodes. In this manner, the following types of filters are respectively formed: a band-pass filter consisting of three stages of resonators in a region indicated by F2; a band-pass filter formed of four stages of resonators in a region indicated by F3; and band-elimination filters (trap circuits), each formed of a one-stage resonator, in regions indicated by F1 and F4, respectively. Further, the input/output-coupling electrodes 33*a*, 33*b* and 33*c* are used as a transmitting (Tx) terminal, an antenna (ANT) terminal, and a receiving (Rx) terminal, respectively. In this manner, an antenna-duplexer unit is formed.

The above known type of antenna-duplexer unit, such as the one shown in FIGS. 14(A) and 14(B), however, presents the following problems. Either the transmitting filter or the receiving filter in this unit is adapted to reject the pass band of the other filter due to its respective band-pass filter characteristics. This requires a large number of resonator stages, which would otherwise fail to obtain a sufficient attenuation in the attenuation band, thereby inevitably enlarging the unit. One possible measure to overcome the above drawback may be to use a band-elimination filter as the transmitting filter. If, however, a multi-passband filter is formed of a single dielectric block, a transmission-line conductor is required for coupling adjacent resonators with a phase difference of $\pi/2$ (rad). As the transmission line, a microstripline on a dielectric should be used, and the electric length of the microstripline is accordingly longer than the length of the resonator, thereby increasing the dimensions of the space required for an array of the resonators.

Moreover, if the foregoing problem encountered by the known antenna-duplexer unit is solved simply by using a band-elimination filter as the transmitting filter, the impedance in the passband of the receiving filter, i.e., in the elimination band of the transmitting filter, as viewed from the receiving filter to the transmitting filter, becomes approximately zero. Thus, a receiving signal input from the antenna disadvantageously flows into the transmitting filter rather than the receiving filter. In order to avoid this inconvenience, a phase shifter having an electric length of $\pi/2$ may be provided between the transmitting filter and the antenna terminal so that the impedance viewed from the receiving filter in the stop band of the transmitting filter becomes approximately infinite. However, this requires a large number of parts, which further increases the cost.

SUMMARY OF THE INVENTION

Accordingly, it is an advantage of the present invention to provide a multi-passband filter formed of a plurality of filters including a band-elimination filter, without increasing the size of the band-elimination filter.

It is another advantage of the present invention to provide a multi-passband filter formed of a plurality of filters including a band-elimination filter, free from the above-described problems, in which the band-elimination filter in the elimination band is substantially an open circuit as viewed from the other filter without requiring a phase shifter when the band-elimination filter and the other filter are combined so as to be able to input or output signals through a common input/output terminal.

The invention provides a multi-passband filter of the above mentioned kind, which is characterized in that at least one pair of said resonant lines are interdigitally coupled to each other by orienting the open ends and short-circuited ends of said resonant lines in opposite directions to each other, thereby providing a band-elimination filter.

In the above filter, the interdigitally-coupled portion serves as a band-elimination filter (trap circuit). More specifically, in the above-described structure, the self capacitance between a ground electrode and each of the above-described interdigitally-coupled resonant lines per unit length is indicated by $C_{11}$, while the inter-line mutual capacitance between the two resonant lines per unit length is represented by $C_{12}$. Then, the even-mode characteristic impedance Ze, the odd-mode characteristic impedance Zo, and the coupling-characteristic impedance Zk are respectively expressed by the following equations:

$$Ze=\sqrt{(\epsilon r)}/(vc\cdot C_{11})$$

$$Zo=\sqrt{(\epsilon r)}/\{vc(C_{11}+2C_{12})\}$$

$$Zk=2Ze\cdot Zo/(Ze-Zo)=\sqrt{(\epsilon r)}/(vc\cdot C_{12})$$

wherein $\epsilon r$ indicates the relative dielectric constant of the dielectric member used in this unit, and vc designates the velocity of light. The above-described interdigitally-coupled portion of the two resonant lines can be represented by an equivalent circuit in which a series circuit formed of the coupling-characteristic impedance Zk between the two resonant lines and the even-mode characteristic impedance Ze of one resonant line is connected in parallel to the even-mode characteristic impedance Ze of the other resonant line, thereby forming a trap circuit.

If the length of each resonant line is designated by L, the electric length $\theta$ can be expressed by the following equation:

$$\theta=\omega\sqrt{(\epsilon r)}\cdot L/vc$$

where $\theta$ is equal to $\pi/2$, and $\omega$ equals $2\pi f$, and thus, the trap frequency $f_T$ of the foregoing trap circuit can be expressed by the following equation.

$$f_T=vc/\{4\sqrt{(\epsilon r)}\cdot L\}$$

In this manner, a plurality of pairs of resonant lines are provided in such a manner that in each pair of line the open end and the short-circuited end of one line are located in positions opposite to those of the other line.

Thus, the band-elimination filter characteristics in which signals are attenuated in a predetermined bandwidth can be obtained without requiring a transmission line, which is conventionally needed for coupling the adjacent resonators with an electric length of $\pi/2$. Accordingly, only a limited space is required for disposing the band-elimination filter in the unit, thereby downsizing the overall unit.

In the above multi-passband filter, at least one pair of said resonant lines may be comb-line coupled to each other in such a manner that the open ends and the short-circuited ends of said resonant lines are located in corresponding positions with respect to each other, thereby providing a band-pass filter.

With this configuration, it is possible to implement an antenna-duplexer unit having a band-elimination filter as a transmitting filter and a band-pass filter as a receiving filter.

In the above multi-passband filter, said dielectric member may be a dielectric block, and said plurality of resonant lines may be provided within said dielectric block.

In the above multi-passband filter, said dielectric member may be a dielectric plate, and said plurality of resonant lines may be provided on said dielectric plate.

In the above multi-passband filter, a non-conductive portion is preferably provided at a part of at least one of said resonant lines to form said open end thereof.

With this arrangement, the position and width of each of the gaps are determined or adjusted in the adjusting process step to easily achieve the desired characteristics while maintaining the overall configuration arid dimensions of the dielectric member, and the resonant lines. When the open ends formed by the non-conductive portions are positioned within the dielectric block, electromagnetic leakage to the exterior from the unit and electromagnetic coupling with an external circuit are reduced, thereby realizing stable characteristics.

When said dielectric member is a dielectric block and said plurality of resonant lines are provided within said dielectric block, one end of each of said resonant lines on a surface of said dielectric block may be opened, and a coupling electrode for coupling the adjacent resonant lines may be provided at said one end of each of said resonant lines.

With this arrangement, the configuration and pattern of the resonant lines within the dielectric block can be simplified.

In the above multi-passband filter, an input/output-coupling electrode may be provided to couple to one of said resonant lines providing said band-elimination filter with a phase shift of an electric angle of $\pi/2$, wherein said one of said resonant lines providing said band-elimination filter is the first or last one thereof.

With this configuration, the impedance in the attenuation band of the band-elimination filter as viewed from the other filter can be shifted from approximately zero to substantially infinite, in other words, the band-elimination filter can be substantially an open circuit as viewed from the other filter. As a consequence, when the foregoing filter unit is employed as an antenna-duplexer unit in which the band-elimination filter is used as transmitting filter, a receiving signal can be reliably transmitted to the receiving filter, which would otherwise flow into the transmitting filter and be attenuated.

BRIEF DESCRIPTION OF THE DRAWINGS

FIGS. 5(A) through 5(D) schematically illustrate a multi-passband filter according to a second embodiment of the present invention;

FIG. 6 is a diagram illustrating the equivalent circuit of the filter shown in FIG. 5;

FIGS. 9(A) through 9(D) schematically illustrate a multi-passband filter according to a fourth embodiment of the present invention;

FIGS. 10(A) through 10(D) schematically illustrate a multi-passband filter according to a fifth embodiment of the present invention;

Other features and advantages of the invention will become more apparent from the following description of embodiments thereof, which refers to the accompanying drawings.

DETAILED DESCRIPTION OF EMBODIMENTS OF THE INVENTION

Figure 1A:
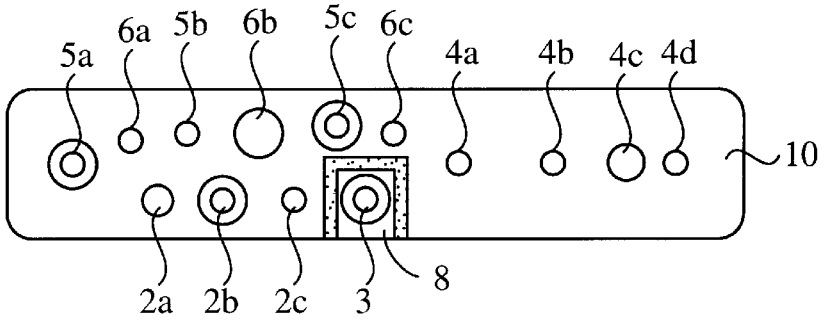
FIGS. 1(A) through 1(D) schematically illustrate a multi-passband filter according to a first embodiment of the present invention.
Figure 1B:
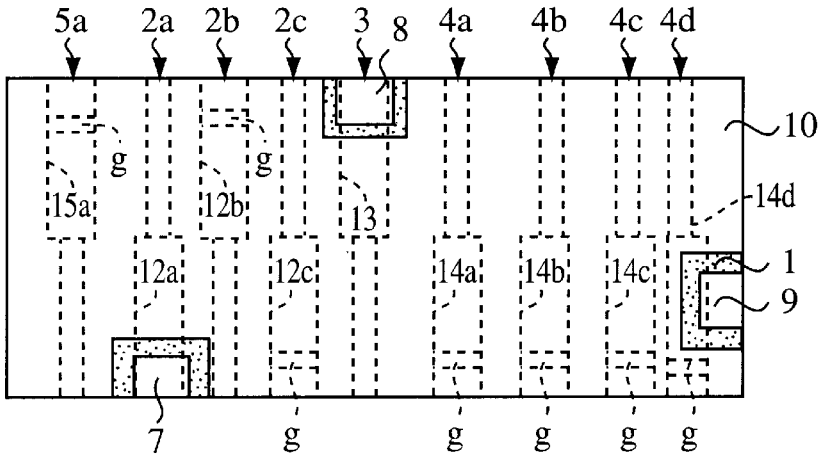
Figure 1C:
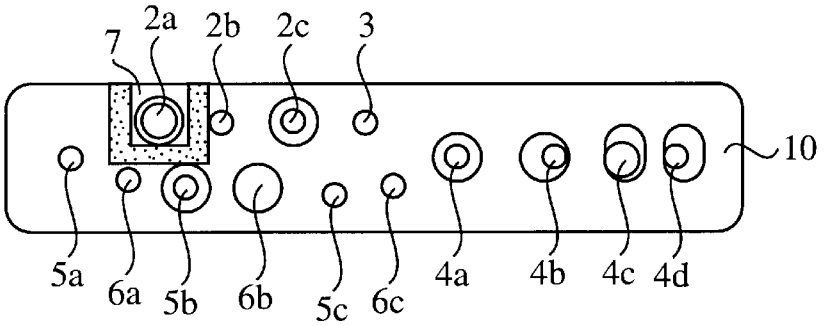
Figure 1D:
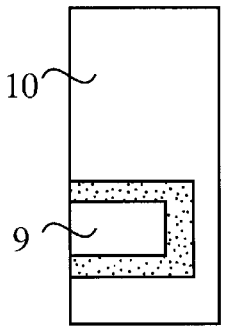

FIG. 1(A) schematically illustrates the top surface of a multi-passband filter; FIG. 1(B) illustrates the front surface of the filter; FIG. 1(C) illustrates the bottom surface of the filter; and FIG. 1(D) illustrates the right lateral surface of the filter.

This filter is formed of a rectangular prism-shaped dielectric block 1 provided with various holes and electrodes. More specifically, the filter has resonant-line holes 2*a*, 2*b* and 2*c*, and 5*a*, 5*b* and 5*c* for the transmitting filter and resonant-line holes 4*a*, 4*b*, 4*c* and 4*d* for the receiving filter, both of which are used when the filter is employed as an antenna-duplexer. The filter also includes an input/output-coupling-line hole 3. FIG. 1(B) shows that the resonant-line holes are each formed as a stepped hole having different internal diameters between the upper and lower halves in which an electrode is disposed to form a resonant line. It should be noted that the holes 5*b* and 5*c* are not shown in FIG. 1(B) for the purpose of clarity. Resonant lines 12*a*, 12*b* and 12*c* are formed in the resonant-line holes 2*a*, 2*b* and 2*c*, respectively; a resonant line 15*a* is disposed in the resonant-line hole 5*a*; and resonant lines 14*a*, 14*b*, 14*c* and 14*d* are provided in the resonant-line holes 4*a*, 4*b*, 4*c* and 4*d*, respectively. Further, an input/output-coupling resonant line (input/output-coupling electrode) 13 is formed in the input/output-coupling-line hole 3.

Moreover, each of the resonant lines other than the resonant line 12*a* and the input/output-coupling resonant line 13 is provided with a non-conductive portion indicated by g in the vicinity of the outer end of the enlarged portion of the stepped hole, the portion g defining an open end.

In FIG. 1(A), there are shown ground holes 6*a*, 6*b* and 6*c*, which are formed as straight holes having a constant internal diameter, an electrode being provided within the entire length of each of the holes 6*a*, 6*b* and 6*c*. Formed on the outer surfaces of the dielectric block 1 are input/output terminals 7 and 8, continuously extending from the resonant lines 12*a* and 13, respectively, and an input/output terminal 9, which is capacitively coupled with the resonant line 14*d*. Additionally, a ground electrode 10 is formed over substantially all of the surfaces (six surfaces) of the block 1 apart from the input/output terminals 7, 8 and 9.

The operation of the multi-passband filter constructed as described above is as follows. The resonant lines 14*a*, 14*b*, 14*c* and 14*d* respectively formed in the holes 4*a*, 4*b*, 4*c* and 4*d* are comb-line-coupled to each other, while the resonant line 14*a* and the input/output-coupling resonant line 13 are interdigitally-coupled. With this arrangement, a band-pass filter is formed between the input/output terminals 8 and 9.

Meanwhile, the resonant lines 12*a*, 12*b* and 12*c* respectively provided in the holes 2*a*, 2*b* and 2*c* are interdigitally-coupled to each other, and the resonant line 12*c* and the input/output-coupling resonant line 13 are also interdigitally-coupled.

Moreover, the resonant lines formed in the respective holes 5*a*, 5*b* and 5*c* are interdigitally-coupled to the resonant lines 12*a*, 12*b* and 12*c*, respectively. In other words, interdigital-coupling is established between the two resonant lines formed in the respective holes 2*a* and 5*a*, between the resonant lines provided in the respective holes 2*b* and 5*b*, and between the resonant lines formed in the respective holes 2*c* and 5*c*.

Accordingly, the input/output terminals 7 and 8 are coupled to each other with a phase shift of $\pi/2$ between each of the resonant lines 12*a*, 12*b* and 12*c* so as to form a band-elimination filter having three trap circuits. The ground hole 6*a* interrupts the coupling force between the resonant-line holes 5*a* and 5*b* by its shielding action, while the ground hole 6*b* intercepts the coupling force between the resonant-line holes 5*b* and 5*c* by its shielding action. Similarly, the ground hole 6*c* interrupts the coupling force between the resonant-line holes 4*a* and 5*c* by its shielding action.

Figure 4:
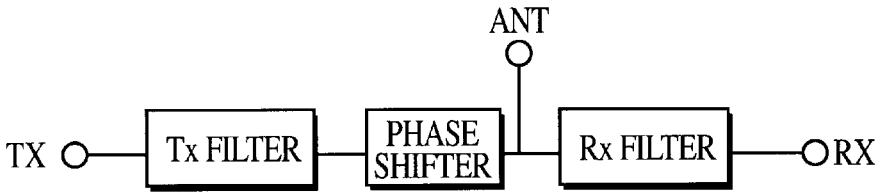
FIG. 4 is a block diagram illustrating the filter shown in FIG. 1.

As noted above, in FIGS. 1(A)–1(D), the resonant line 12*c*, which serves as the last resonant line constituting the transmitting filter, is interdigitally-coupled to the input/output-coupling resonant line (input/output-coupling electrode) 13 with a phase shift of $\pi/2$. This interdigital coupling can be represented by the block diagram of FIG. 4. With this configuration, in the attenuation band of the transmitting filter, the impedance of the transmitting filter viewed from the input/output-coupling resonant line 13 is substantially infinite, and a receiving signal from the antenna is thus input into the receiving filter rather than the transmitting filter.

Figure 2:
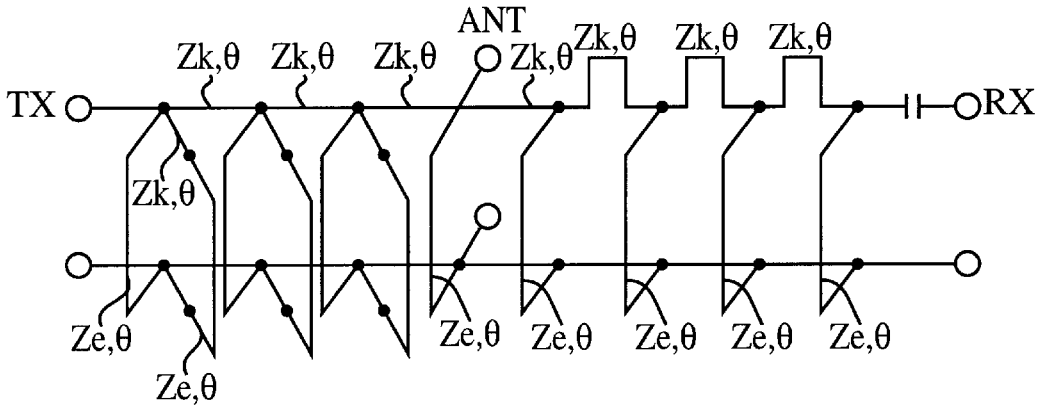
FIG. 2 is a diagram illustrating the equivalent circuit of the filter shown in FIG. 1.

FIG. 2 is a diagram illustrating the equivalent circuit of the multi-passband filter shown in FIGS. 1(A)–1(D). In this diagram, Ze and θ respectively represent the even-mode characteristic impedance and the electric angle of each resonant line shown in FIGS. 1(A)–1(D). Zk and θ indicated on the horizontal straight line connecting the transmitting filter and the receiving filter shown in FIG. 2 respectively designate the coupling characteristic impedance and the electric angle between the resonant lines 12*a*, 12*b* and 12*c*, between the resonant lines 14*a*, 14*b*, 14*c* and 14*d*, between the input/output-coupling resonant line 13 and the resonant line 14*a*, and between the input/output-coupling resonant line 13 and the resonant line 12*c*. Further, Zk and θ on the lines branched from the above-described straight lines respectively indicate the coupling characteristic impedance and the electric angle between the resonant lines formed in the holes 5*a*, 5*b* and 5*c* and the resonant lines 12*a*, 12*b* and 12*c*, respectively.

Figure 3:
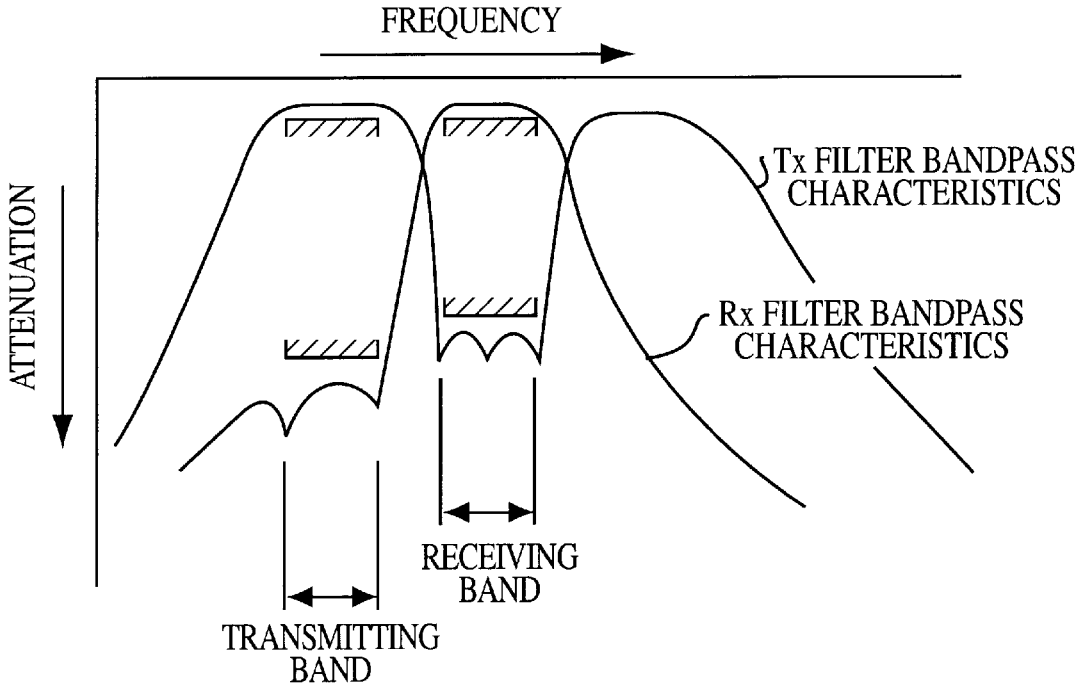
FIG. 3 illustrates the band-pass characteristics of the filter shown in FIG. 1.

FIG. 3 illustrates the band-pass characteristics of the multi-passband filter shown in FIGS. 1(A)–2. FIG. 3 reveals that the band-pass characteristics of the transmitting filter (Tx filter) result from synthesizing the band-pass filter characteristics exhibited by the resonant lines 12*a*, 12*b* and 12*c* and the input/output-coupling resonant line 13 with the band-elimination filter characteristics of the foregoing three trap circuits, while the band-pass characteristics of the receiving filter (Rx filter) originate from the band-pass filter characteristics exhibited by the resonant lines 14*a*, 14*b*, 14*c* and 14*d* shown in FIGS. 1(A)–1(D). The attenuation band of the transmitting filter and the pass band of the receiving filter coincide with the receiving band, while the pass band of the transmitting filter and the attenuation band of the receiving filter match the transmitting band. As a consequence, the foregoing multi-passband filter can be used as an antenna-duplexer.

FIG. 5(A) schematically illustrates the top surface of a multi-passband filter according to a second embodiment of the present invention; FIG. 5(B) illustrates the front surface of the filter; FIG. 5(C) illustrates the bottom surface of the filter; and FIG. 5(D) illustrates the right lateral surface of the filter. This filter, like the counterpart shown in FIGS. 1(A)–1(D), is formed of a rectangular prism-shaped dielectric block 1 provided with various holes and electrodes. The filter of the second embodiment, however, differs from the filter of the first embodiment in the following respects. First, the resonant-line holes 4*d* and 2*a*, and the input/output-coupling-line hole 3 are formed as straight holes with a constant diameter, and an input/output terminal 9 is directly connected to one end of the resonant-line hole 4*d*. Further, a ground hole 6*d* is provided in the vicinity of the resonant-line hole 4*d* to weaken the coupling force between the resonant line 14*c* and the resonant line 14*d*, which serves as the last resonant line of the receiving filter, thereby shortening the distance between the resonant-line holes 4*c* and 4*d*. Additionally, the position and size of the ground hole 6*d* can be changed to adjust the external Q (Qe). Also, the ground hole 6*b* is elongated in its cross-sectional shape.

FIG. 6 is a diagram illustrating the equivalent circuit of the multi-passband filter shown in FIGS. 5(A)–5(D). FIG. 6 reveals that the second embodiment in which an input/output terminal is directly connected to a resonant-line hole of the receiving filter exhibits characteristics similar to those obtained by the first embodiment.

Figure 7A:
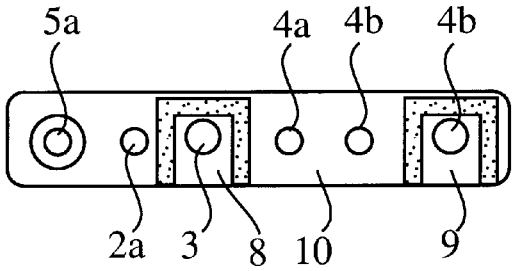
FIGS. 7(A) through 7(D) schematically illustrate a multi-passband filter according to a third embodiment of the present invention.
Figure 7B:
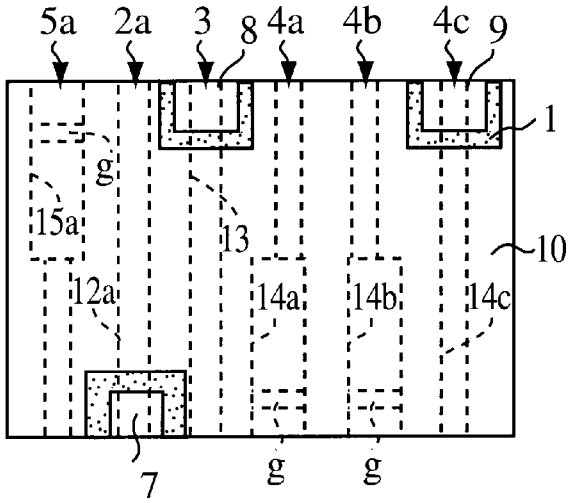
Figure 7D:
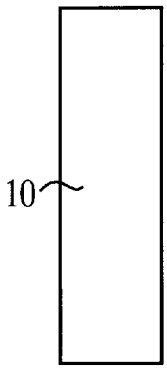
Figure 7C:
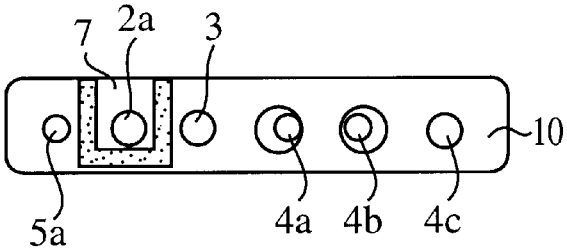

FIGS. 7(A)–7(D) and 8 illustrate the configuration of a multi-passband filter according to a third embodiment of the present invention. In this filter, the number of resonant lines is fewer than the number of resonators in the multi-passband filter of the second embodiment shown in FIGS. 5(A)–6. More specifically, FIG. 7(A) illustrates the top surface of the above type of filter; FIG. 7(B) illustrates the front surface of the filter; FIG. 7(C) illustrates the bottom surface of the filter; and FIG. 7(D) illustrates the right lateral surface of the filter. The filter is formed of a rectangular prism-shaped dielectric block 1. Resonant-line holes 5*a*, 2*a*, 4*a*, 4*b*, and 4*c* and an input/output-coupling line hole 3 are provided in the dielectric block 1 within which resonant lines 15*a*, 12*a*, 14*a*, 14*b*, 14*c*, and an input/output-coupling resonant line 13 are respectively formed. Input/output terminals 7 and 9 are respectively disposed at the ends of the resonant-line holes 2*a* and 4*c*, while an input/output terminal 8 is provided at an end of the input/output-coupling line hole 3.

Figure 8:
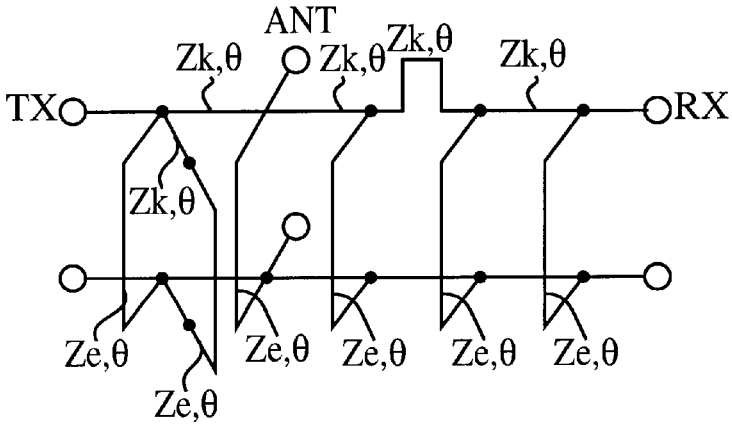
FIG. 8 is a diagram illustrating the equivalent circuit of the filter shown in FIG. 7.

FIG. 8 is a diagram illustrating the equivalent circuit of the filter shown in FIGS. 7(A)–7(D). With this configuration, it is possible to implement an antenna-duplexer formed by integrating a transmitting filter having band-stop characteristics with one trap circuit, and a receiving filter exhibiting band-pass characteristics including two comb-line-coupled resonators.

FIGS. 9(A)–9(D) schematically illustrate a multi-passband filter according to a fourth embodiment of the present invention. In this filter, the number of resonators is reduced by one from the resonators of the transmitting filter shown in FIGS. 5(A)–5(D). The other configurations are similar to those of the filter shown in FIGS. 5(A)–5(D). Accordingly, the input/output terminal 7 provided at the end of the resonant line 12*a* is shown on the top surface of the filter, as illustrated in FIG. 9(A), and all the input/output terminals 7, 8 and 9 are thus in the same plane.

FIGS. 10(A)–10(D) schematically illustrate a multi-passband filter according to a fifth embodiment of the present invention. This filter differs from the counterparts of the foregoing embodiments in that one end of each resonant-line hole is open-circuited and has an electrode pattern, preferably rectangular, disposed thereat, and that all the resonant-line holes are formed as straight holes having a constant diameter. With this arrangement, the formation of a non-conductive portion within each resonant-line hole is unnecessary, and the resonant-line holes can be formed straight with a constant diameter, thereby easily fabricating the filter. The equivalent circuit of the multi-passband filter of the fifth embodiment is similar to the counterpart of the second embodiment shown in FIG. 6.

According to the foregoing embodiments, the filter is formed by using a single dielectric block. In contrast, in the below-described embodiments, a dielectric plate is used in place of the dielectric block.

Figure 11:
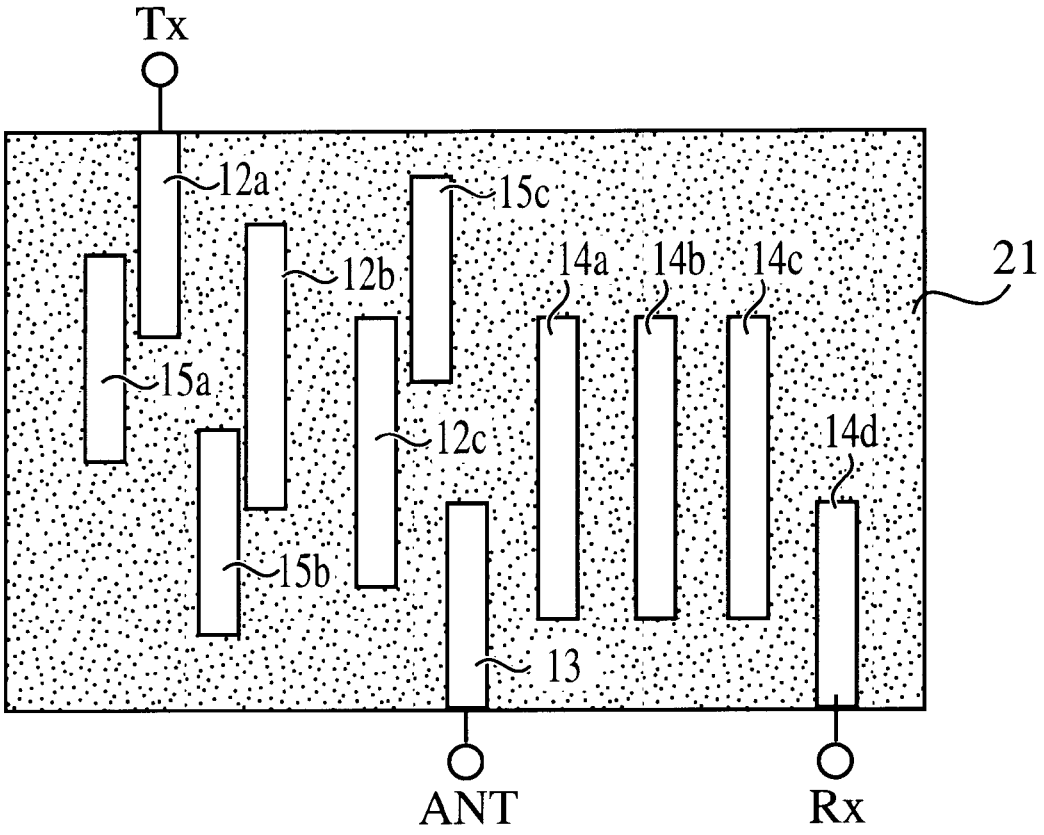
FIG. 11 is a plan view of a multi-passband filter according to a sixth embodiment of the present invention.

FIG. 11 is a plan view of a multi-passband filter according to a sixth embodiment of the present invention. In FIG. 11, the filter employs a dielectric plate 21 on which resonant lines 12*a*, 12*b*, 12*c*, 14*a*, 14*b*, 14*c*, 14*d*, 13, 15*a*, 15*b*, and 15*c* are formed. The resonant lines 14*a*, 14*b* and 14*c* function as a $\lambda/2$ resonator with both ends open-circuited, and are comb-line-coupled to each other. Further, the resonant lines 13 and 14*a* are interdigitally-coupled to each other, and the resonant lines 14*c* and 14*d* are also interdigitally-coupled to each other. As a consequence, a band-pass filter can be formed between the ANT terminal and the Rx terminal.

Meanwhile, the resonant lines 12*a*, 12*b*, 12*c* and 13 are interdigitally-coupled to each other, and interdigital-coupling is also established between the resonant lines 12*a* and 15*a*, between the lines 12*b* and 15*b*, and between the lines 12*c* and 15*c*, thereby forming three trap circuits. Accordingly, the band-elimination filter characteristics formed by synthesizing the band-pass filter characteristics exhibited by the resonant lines 12*a*, 12*b*, 12*c* and 13 with the band-elimination filter characteristics of the above three trap circuits can be obtained between the Tx terminal and the ANT terminal. As a result, the equivalent circuit of the filter of this embodiment is similar to that of the counterpart of the second embodiment shown in FIGS. 5(A)–5(D).

Figure 12A:
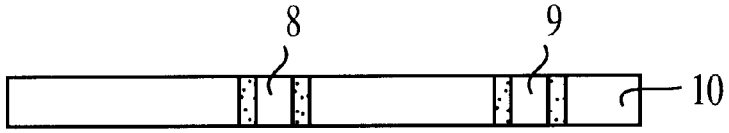
FIGS. 12(A) through 12(D) schematically illustrate a multi-passband filter according to a seventh embodiment of the present invention.
Figure 12B:
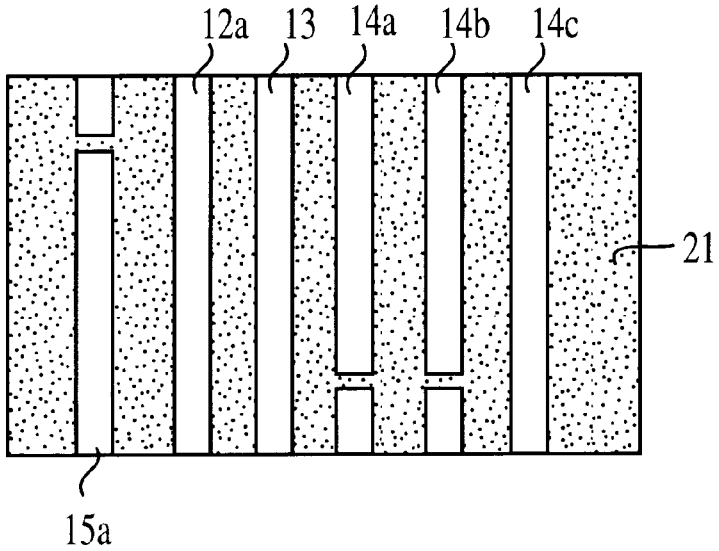
Figure 12C:
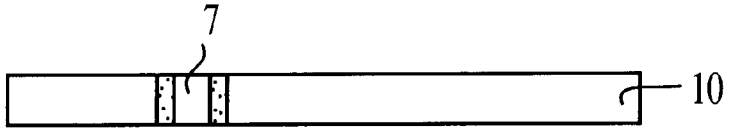
Figure 12D:
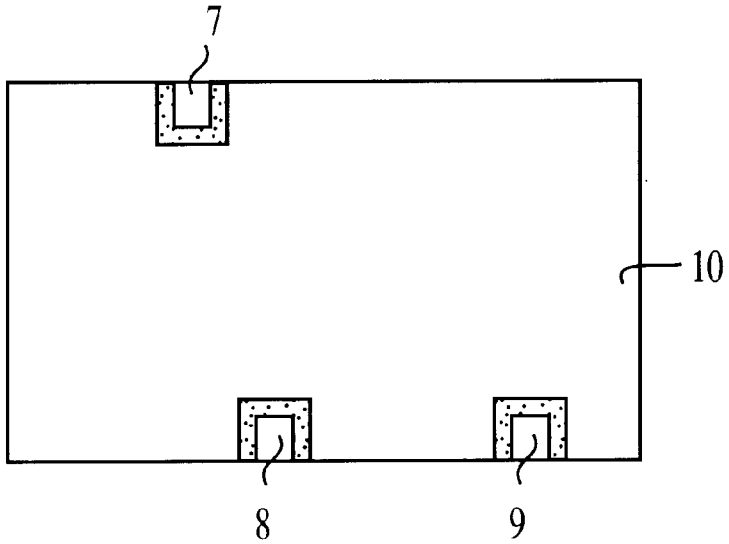
Figure 13A:
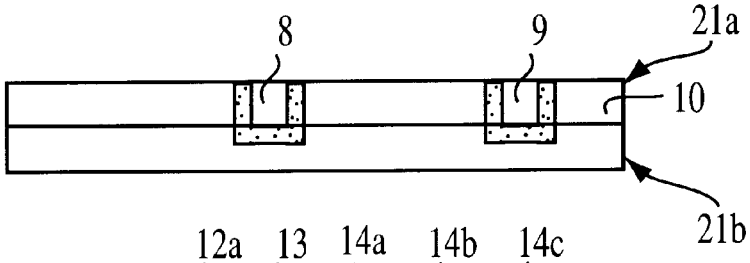
FIGS. 13(A) through 13(D) schematically illustrate a multi-passband filter according to an eighth embodiment of the present invention.
Figure 13B:
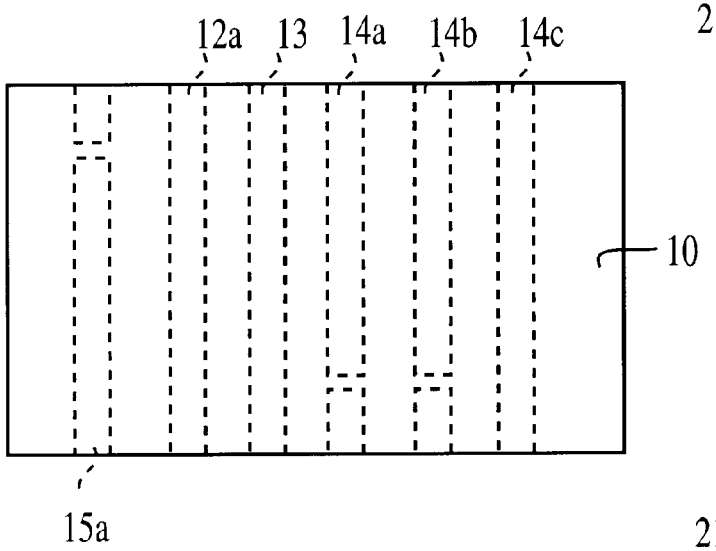
Figure 13C:
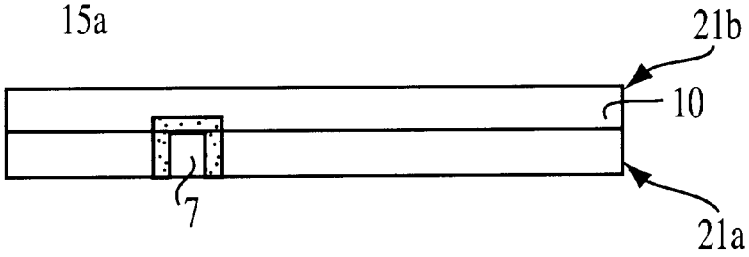
Figure 13D:
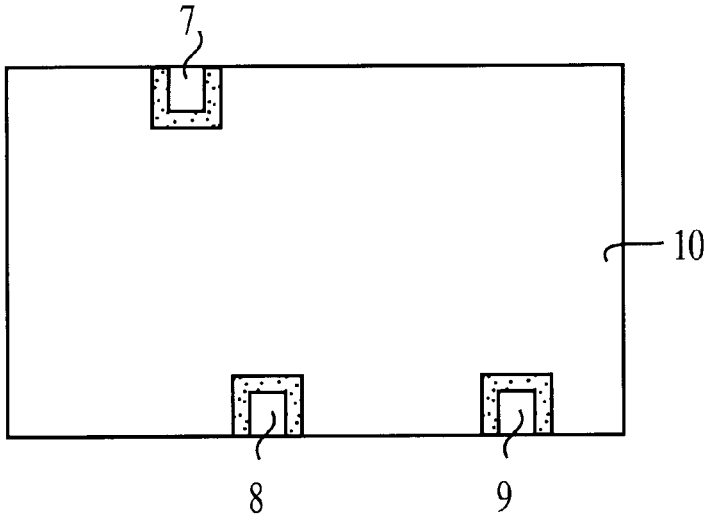
Figure 14A:
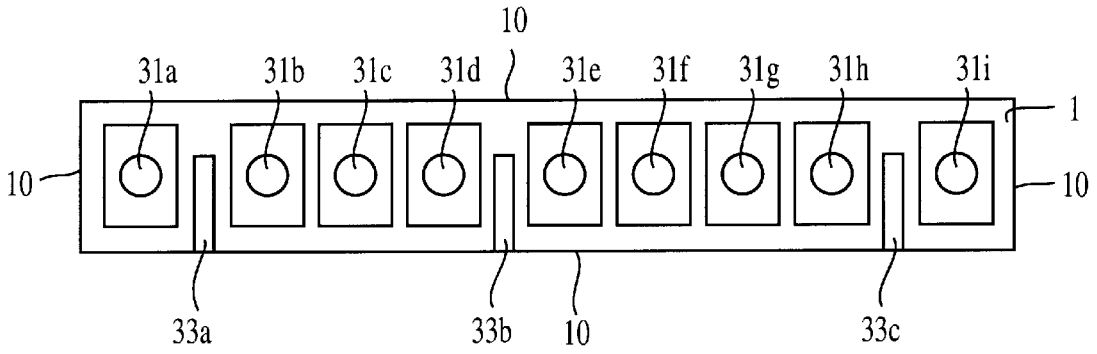
FIG. 14A PRIOR ART
FIGS. 14(A) and 14(B) schematically illustrate a front view and a longitudinal sectional view of a conventional multi-passband filter.
Figure 14B:
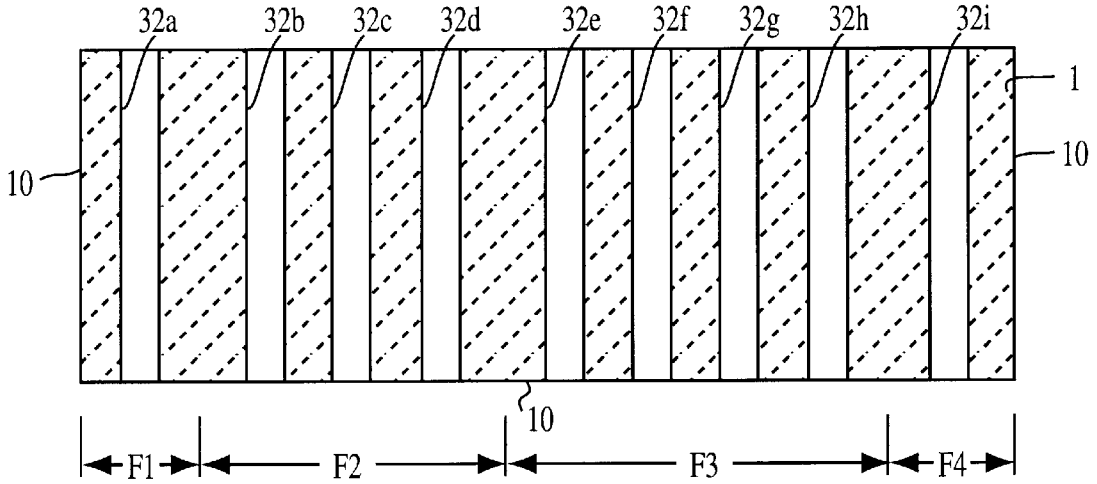
FIG. 14B PRIOR ART

FIG. 12(A) schematically illustrates the rear surface of a multi-passband filter according to a seventh embodiment of the present invention; FIG. 12(B) illustrates the top surface of the filter; FIG. 12(C) illustrates the front surface of the filter; and FIG. 12(D) illustrates the bottom surface of the filter. Formed on the dielectric plate 21 are resonant lines 15*a*, 12*a*, 13, 14*a*, 14*b* and 14*c*. In the above lines, a non-conductive portion is provided at a predetermined portion of each of the resonant lines 15*a*, 14*a* and 14*b* and provides an open-circuited end. Moreover, input/output terminals 8 and 9, continuously extending from the respective resonant lines 13 and 14*c*, are formed from the rear surface to the bottom surface of the dielectric plate 21, while an input/output terminal 7, continuously extending from the resonant line 12*a*, is provided from the front surface to the bottom surface of the dielectric plate 21. Further, a ground electrode 10 is formed in a region other than the top surface of the dielectric plate 21 and the above-described input/output terminals 7, 8 and 9.

The filter shown in FIGS. 12(A)–12(D) is a modification made to the filter of the third embodiment shown in FIGS. 7(A)–7(D) in such a manner that the dielectric plate 21 is used in place of the dielectric block 1. The operation and characteristics of this modification are similar to those of the third embodiment.

FIGS. 13(A)–13(D) schematically illustrates a multi-passband filter according to an eighth embodiment of the present invention. This filter is a Triplate-type modification of the filter shown in FIGS. 12(A)–12(D). More specifically, the filter of this embodiment has two dielectric plates 21*a* and 21*b*. Various resonant lines similar to those of the filter shown in FIGS. 12(A)–12(D) are formed on one dielectric plate 21*a*, while resonant lines configured mirror-symmetrically to those shown in FIGS. 12(A)–12(D) are disposed on the other dielectric plate 21*b*. Then, the surfaces of the two dielectric plates 21*a* and 21*b* on which the resonant lines are formed are laminated. With this arrangement, since the respective resonant lines are surrounded by the ground electrode 10, electromagnetic leakage to the exterior from the filter and electromagnetic coupling with an external circuit can be inhibited, thereby obtaining a multi-passband filter exhibiting stable characteristics.

As an application of the foregoing embodiments, an antenna-duplexer has been discussed. The present invention is not limited, however, to filters of the types which have a transmitting filter and a receiving filter so as to be usable with a transmitter and a receiver. The invention may more generally be applicable to filters which filter a plurality of input signals to obtain one output, or filters which filter one input signal to obtain a plurality of outputs.

What is claimed is:

1. A duplexer comprising:

a dielectric member, a plurality of resonant lines associated with said dielectric member, each of said resonant lines being coupled to an adjacent one of said resonant lines, a first input/output terminal, a second input/output terminal, and a common terminal disposed on said dielectric member, at least one pair of said resonant lines being interdigitally coupled to each other with respective open-circuited ends and short-circuited ends of said resonant lines being located at opposite portions of said dielectric member, thereby providing a band-elimination filter connected between said first input/output terminal and said common terminal, and at least one pair of said resonant lines being comb-line coupled to each other with respective open-circuited ends and short-circuited ends of said resonant lines being located in the same portions of said dielectric member, thereby providing a second filter connected between said common terminal and said second input/output terminal.

2. A duplexer according to claim 1, wherein said second filter is a band-pass filter.

3. A duplexer according to claim 2, wherein said dielectric member is a dielectric block, and said plurality of resonant lines are provided within said dielectric block.

4. A duplexer according to claim 2, wherein said dielectric member is a dielectric plate, and said plurality of resonant lines are provided on said dielectric plate.

5. A duplexer according to claim 3, wherein one end of each of said resonant lines at a surface of said dielectric block defines said open-circuited end, and a coupling electrode for coupling said adjacent resonant lines is provided at said open-circuited end of each of said resonant lines.

6. A duplexer according to claim 5, wherein one of said resonant lines is an input/output-coupling electrode which is connected to one of said terminals and which couples to a first one or a last one of said resonant lines providing said band-elimination filter with a phase shift of an electric angle of $\pi/2$.

7. A duplexer according to claim 1, wherein said dielectric member is a dielectric block, and said plurality of resonant lines are provided within said dielectric block.

8. A duplexer according to claim 1, wherein said dielectric member is a dielectric plate, and said plurality of resonant lines are provided on said dielectric plate.

9. A duplexer according to claim 2, wherein one of said resonant lines is an input/output-coupling electrode which is connected to one of said terminals and which couples to a first one or a last one of said resonant lines providing said band-elimination filter with a phase shift of an electric angle of $\pi/2$.

10. A duplexer according to claim 1, wherein one of said resonant lines is an input/output-coupling electrode which is connected to one of said terminals and which couples to a first one or a last one of said resonant lines providing said band-elimination filter with a phase shift of an electric angle of $\pi/2$.

11. A duplexer comprising a plurality of filters in which a plurality of resonant lines are provided within a dielectric substrate, so that a plurality of stages of resonators are formed by the resonant lines, first and second input/output terminals and a common terminal disposed on said dielectric substrate, wherein among said plurality of resonant lines at least two resonant lines each having an open-circuited end and a short-circuited end are interdigitally-coupled to each other in such a manner that the open-circuited end and the short-circuited end of one resonant line are located at portions of said dielectric substrate opposite to the open-circuited end and the short-circuited end of the other resonant line, thereby forming a band-elimination filter connected between said first terminal and said common terminal, and another two of said resonant lines are comb-line coupled with each other and connected between said common terminal and said second terminal.

12. A duplexer comprising a plurality of filters in which a plurality of resonant lines are provided within a dielectric substrate, and a non-conductive portion is provided for each of said resonant lines to define an open-circuited end thereof, so that a plurality of resonators are formed by the adjacent resonant lines, first and second input/output terminals and a common terminal disposed on said dielectric substrate, and wherein among said plurality of resonant lines at least two resonant lines each having an open end and a short-circuited end are interdigitally-coupled to each other in such a manner that the open-circuited end and the short-circuited end of one resonant line are located at portions of said dielectric substrate opposite to the open end and the short-circuited end of the other resonant line, thereby forming a band-elimination filter connected between said first terminal and said common terminal, and another two of said resonant lines are comb-line coupled with each other and connected between said common terminal and said second terminal.

13. A duplexer comprising a plurality of filters in which a plurality of resonant lines are provided within a dielectric block, and one end of each of said resonant lines is open-circuited and a coupling electrode for coupling adjacent resonant lines is provided at said one end, first and second input/output terminals and a common terminal disposed on said dielectric block, wherein among said plurality of resonant lines at least two resonant lines, each having an open-circuited end and a short-circuited end, are interdigitally-coupled to each other in such a manner that the open end and the short-circuited end of one resonant line are located in respective portions of said dielectric block opposite to the open end and the short-circuited end of the other resonant line, thereby forming a band-elimination filter connected between said first terminal and said common terminal, and another two of said resonant lines are comb-line coupled with each other and connected between said common terminal and said second terminal.

14. A multi-passband filter according to any one of claims 1, 2, 3, 4, 7 and 8, wherein said open-circuited end is defined by a non-conductive portion in at least one of said resonant lines.

15. A duplexer according to claim 14, wherein one of said resonant lines is an input/output-coupling electrode which is connected to one of said terminals and which couples to a first one or a last one of said resonant lines providing said band-elimination filter with a phase shift of an electric angle of $\pi/2$.

16. A duplexer comprising a plurality of filters in which a plurality of resonant lines are provided on a dielectric substrate, so that a plurality of stages of resonators are formed by the resonant lines, first and second input/output terminals and a common terminal disposed on said dielectric substrate, wherein among said plurality of resonant lines at least two resonant lines each having an open-circuited end and a short-circuited end are interdigitally-coupled to each other in such a manner that the open-circuited end and the short-circuited end of one resonant line are located at portions of said dielectric substrate opposite to the open-circuited end and the short-circuited end of the other resonant line, thereby forming a band-elimination filter connected between said first terminal and said common terminal, and another two of said resonant lines are comb-line coupled with each other and connected between said common terminal and said second terminal.

17. A duplexer comprising a plurality of filters in which a plurality of resonant lines are provided on a dielectric substrate, and a non-conductive portion is provided for each of said resonant lines to define an open-circuited end thereof, so that a plurality of resonators are formed by the adjacent resonant lines, first and second input/output terminals and a common terminal disposed on said dielectric substrate, and wherein among said plurality of resonant lines at least two resonant lines each having an open end and a short-circuited end are interdigitally-coupled to each other in such a manner that the open-circuited end and the short-circuited end of one resonant line are located at portions of said dielectric substrate opposite to the open end and the short-circuited end of the other resonant line, thereby forming a band-elimination filter connected between said first terminal and said common terminal, and another two of said resonant lines are comb-line coupled with each other and connected between said common terminal and said second terminal.

18. A duplexer according to any one of claims 11–13 and 16–17, further comprising an input/output-coupling electrode which couples to a first-stage resonant line or a final-stage resonant line of said band-elimination filter in an interdigital or a comb-line manner so as to provide a phase shift of an electric angle of $\pi/2$.

19. A duplexer according to claim 7, wherein one end of each of said resonant lines at a surface of said dielectric block defines said open-circuited end, and a coupling electrode for coupling said adjacent resonant lines is provided at said open-circuited end of each of said resonant lines.

* * * * *

UNITED STATES PATENT AND TRADEMARK OFFICE

CERTIFICATE OF CORRECTION

PATENT NO. : 5,986,521

DATED : November 16, 1999

INVENTOR(S) : Hitoshi TADA et al.

It is certified that error appears in the above-identified patent and that said Letters Patent is hereby corrected as shown below:

On the title page item [75], change "Hitoehi" to --Hitoshi--.

Signed and Sealed this

Twenty-eighth Day of November, 2000

*Attest:*

Q. TODD DICKINSON

*Attesting Officer*

*Director of Patents and Trademarks*